US007234283B2

(12) United States Patent
Russo

(10) Patent No.: US 7,234,283 B2
(45) Date of Patent: Jun. 26, 2007

(54) KNOT OF A RETAINING NET

(75) Inventor: Vitaliano Russo, Milan (IT)

(73) Assignee: Sincron S.r.l. (IT)

( * ) Notice: Subject to any disclaimer, the term of this patent is extended or adjusted under 35 U.S.C. 154(b) by 0 days.

(21) Appl. No.: 10/716,260

(22) Filed: Nov. 18, 2003

(65) Prior Publication Data

US 2004/0149976 A1 Aug. 5, 2004

(30) Foreign Application Priority Data

Nov. 19, 2002 (EP) ..... 02425710

(51) Int. Cl.
*E04C 2/42* (2006.01)

(52) U.S. Cl. ..... 52/665; 256/47; 256/48; 256/54; 256/55; 256/12.5

(58) Field of Classification Search ..... 256/12.5, 256/32, 33, 47, 48, 52, 54, 55; 52/665; 403/346, 403/400

See application file for complete search history.

(56) References Cited

U.S. PATENT DOCUMENTS 615,304 A * 12/1898 Propst ..... 256/57
1,781,458 A * 11/1930 Gore ..... 403/388
2,079,034 A 5/1937 Parkin
2,929,121 A * 3/1960 Tinnerman ..... 403/397
6,347,903 B1 2/2002 Knighton
6,347,904 B1 * 2/2002 Knighton ..... 403/400

FOREIGN PATENT DOCUMENTS

JP 2000178925 6/2000

* cited by examiner

*Primary Examiner*—Patricia Engle
*Assistant Examiner*—Michael P. Ferguson
(74) *Attorney, Agent, or Firm*—Akerman Senterfitt

(57) ABSTRACT

A method for making knots (4) of retaining nets (1), such as rock and avalanche fences, wherein a knot (4) consists of a first and a second rope (2,3) crossing over each other and a junction binding said ropes (6), comprises the steps of placing a first and a second U element (7,8) astride said first rope (2) and adjacent to said second rope (3) on opposite sides thereof, linking the ends (7*d*,7*e*) of the first U element (7) to the ends (8*d*,8*e*) of the second U element (8) by means of bridge elements (9*d*,9*e*) overlying said second rope (3), and clamping said second bridge elements (9*d*, 9*e*) on said second rope (3). With such a method a very strong and simple knot (4) can be speedily obtained.

3 Claims, 2 Drawing Sheets

KNOT OF A RETAINING NET

DESCRIPTION

1. Field of Application

The present invention broadly relates to a method for making a retaining net, of the kind that is employed for example to hold off land and rocks, snow and avalanches, so called rock fences and avalanche fences, and particularly to a method for making a knot of said retaining net, to a knot formed by means of said method and to a junction for said knot.

2. Prior Art

In the field of retaining nets, of the above-referred type, such as rock fences, avalanche fences and the like, there is the need of securing the strength of the knots, which is of those points in which two wire ropes cross over and are thereof tyed together by means of a junction.

The traditional method for tying the ropes together in the knot by means of a ligament or very knot between ropes provides a fairly strong bond, but it is time-intensive and hardly suitable for automated processing.

It has been suggested the use of a conventional U-bolt clamp, located where the ropes ross over, with respective U-bolt and thightening nuts. Even if good strength is thus achieved, because the sliding of the knot ropes is made impossible and so there is the undesired widening of the net mesh, this distorts, where ropes cross over, the geometries of the individual meshes and so the overall geometry of the net.

Junctions have been devised, being formed by means of two plate-shaped elements located at the opposite ends of the intersection between the two ropes and closed on themselves because of their bending upon each other, with subsequent formation of a sort of boss. These junctions allow to realize the knot in a fast way, by means of tools, which is a relatively simple press. Anyway these junctions, despite of a series of following improvements, are still unsatisfactory as for their resistance against impulsive stimulus: for instance a falling rock can determine, because of the impact with the net, the opening of the junction, often with distance projection of one or both the plate-shaped elements, in a projectile style, with immediate widening of at least a mesh of the net and causing danger for people. The underlying problem of this invention is to provide a method for making retaining net knots, satisfying the above-referred requirement and overcoming drawbacks of the prior art.

SUMMARY OF THE INVENTION

The above problem is solved by a method for making knots of retaining nets, such as rock and avalanche fences, wherein a knot consists of a first and a second rope crossing over each other and a junction binding said ropes. The method includes the steps of placing a first and a second U element astride the first rope and adjacent to the second rope on opposite sides thereof, linking the ends of the first U element to the ends of the second U element by means of bridge elements overlying second rope, and clamping in the second bridge elements on the second rope. With such a method a very strong and simple knot can be speedily obtained.

BRIEF DESCRIPTION OF THE DRAWINGS

Further features and advantages of the invention will become apparent from the following description of an embodiment thereof, given by way of non-limitative example with reference to the accompanying drawings.

DETAILED DESCRIPTION OF THE INVENTION

Figure 1:
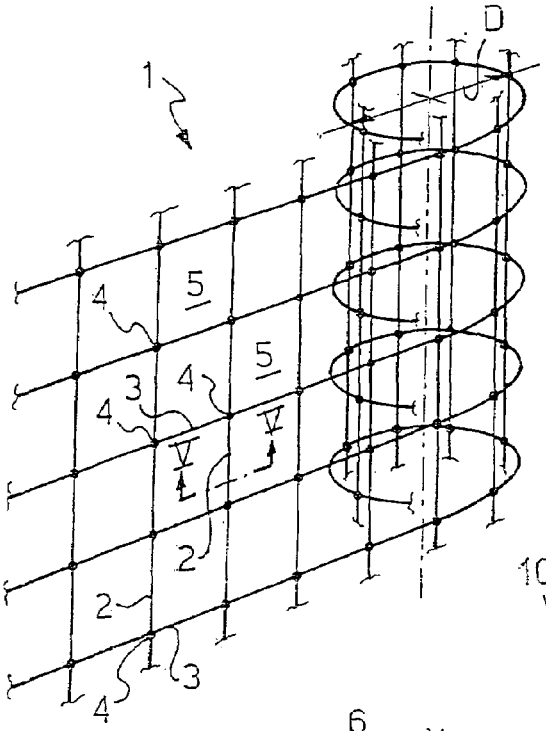
FIG. 1 is a perspective view of a retaining net according to the invention.
Figure 2:
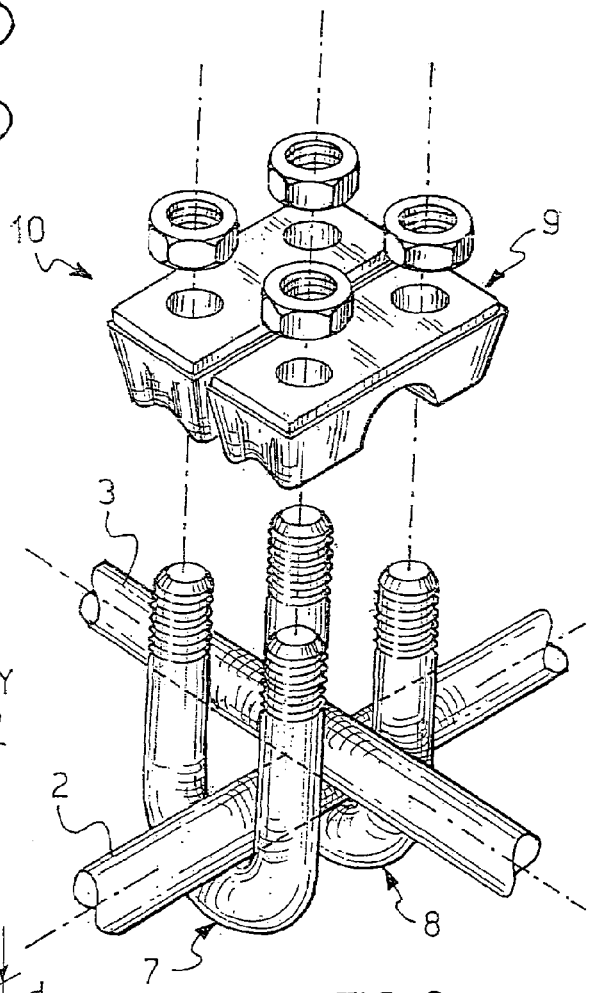
FIG. 2 is a schematic view, exploded and perspective, of a detail of the net shown in FIG. 1, specifically of a knot according to the invention.

With reference to the drawings, FIG. 1 globally shows a retaining net, for retaining land, rocks, snow and avalanches, e.g. a so-called rock fence, according to the invention.

The net 1, that can be rolled up into coils of diameter D, comprises a plurality of warp ropes 2 and a plurality of woof ropes 3 crossing one another at right angles in correspondance of knot points 4 to define meshes 5, square-shaped meshes in this example. The net 1 is meant to operate outstretched, for example stretching hillside, in order to protect roads from falling rocks.

Figure 3:
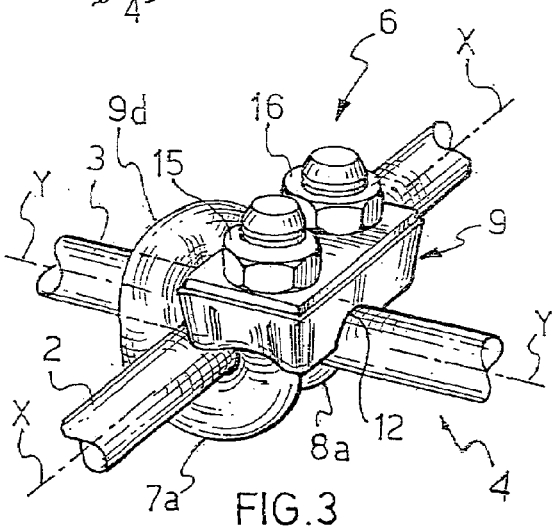
FIGS. 3 and 4 are perspective views of an embodiment of the knot according to the invention, seen from two different angle shots.
Figure 4:
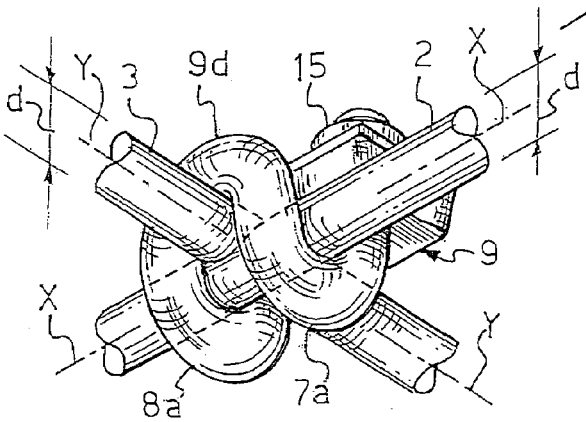
Figure 5:
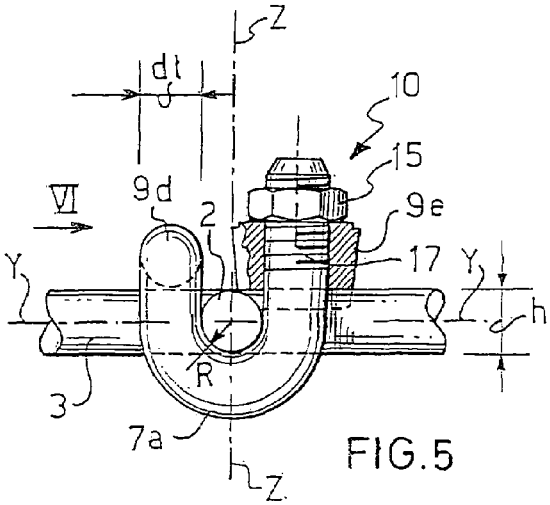
FIG. 5 is a partial section of the side view of the knot shown in FIG. 2.
Figure 6:
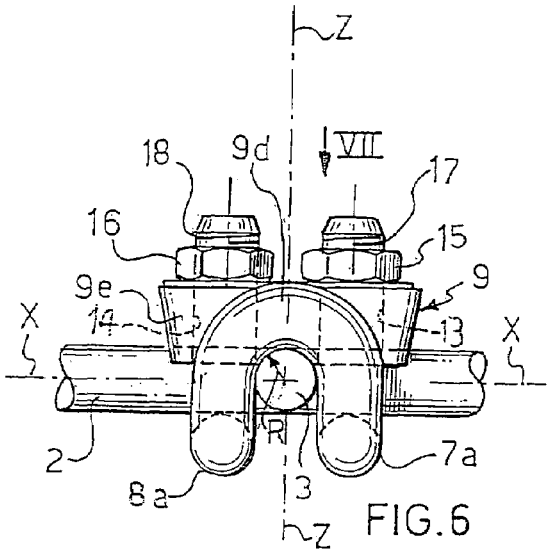
FIG. 6 is a side view of the knot of FIG. 5, taken in the direction of arrow VI.

For each knot 4 (FIG. 3), ropes 2 and 3 extend along directions x—x and y—y respectively, perpendicular to a direction z—z.

The ropes 2 and 3 are made of twisted steel strands. In this example, each rope has seven strands and each strand comprises seven wires. The ropes 2 and 3 of this example are all identical and have a diameter d of 8 mm.

Each knot comprises, besides crossing ropes 2 and 3, a junction 6 binding the ropes together in correspondance of the knot, so as to prevent ropes from detaching and sliding with respect to each other.

The junction 6 comprises a first and a second U-shaped elements 7 and 8. These U elements 7 and 8 are made of a steel cylindrical bar, which is a steel rod, whose diameter is dt, conveniently bent. In this example, dt=8 mm.

The first U element 7 has a curved base 7*a*, and two parallel wings 7*b* and 7*c*, with respective ends 7*d* and 7*e*. The same can be observed for U element 8, which has a curved base 8*a*, two parallel wings 8*b* and 8*c*, with respective ends 8*d* and 8*f*.

The curvature of the curved bases 7*a*, 8*a* is semicircular, with an intrados radius R being approximately one half the rope diameter d, in this case about 4 millimeters.

The two U elements 7 and 8 are positioned side-by-side astride the first rope 2, with their wings equally oriented in the direction z—z, in substance adjacent, at a reciprocal distance approximately equal to d, so that they lie close to the second rope 3 on opposite sides thereof.

The junction further comprises at least a bridge element 9, connecting the ends 7*d*, 7*e* of the U element 7 to the adjacent ends 8*d*, 8*e* of the U element 8. This bridge element 9 is bridge extended on the second rope 3 parallel to the direction x—x of rope 2 and perpendicularly to the direction y—y of rope 3, and it is then clamped on said rope 3 with clamping means globally shown with 10.

Advantageously, the bridge element 9 consists of an arch 9*d* and a yoke 9*e*, both lying in respective parallel planes and perpendicularly to the direction y—y of rope 3.

The arch 9*d* is formed by a steel cylindrical bar, which is a steel rod, conveniently bent, and it merges with the ends 7*d*, 8*d* of the two U elements 7, 8 and is integral with the latter. The curvature of the arch 9*d* is semicircular with an intrados radius equal to R.

Figure 8:
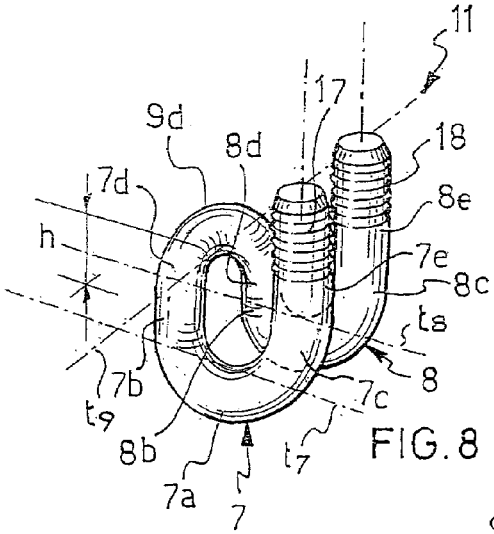
FIG. 8 is a perspective view of an element of the knot shown in FIG. 2.
Figure 7:
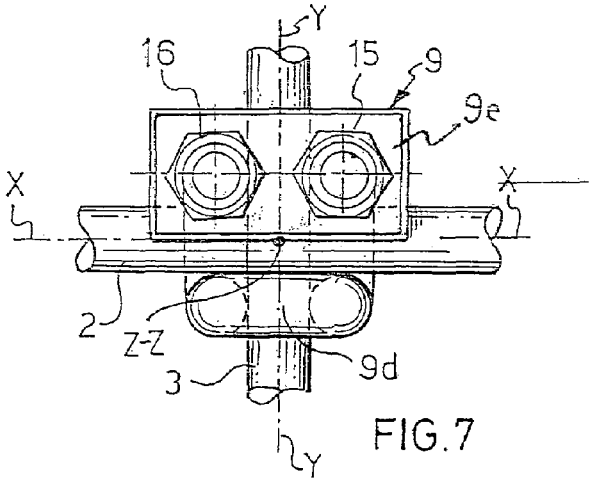
FIG. 7 is a front view of the knot of FIG. 5, taken in the direction of arrow VII.
Figure 9:
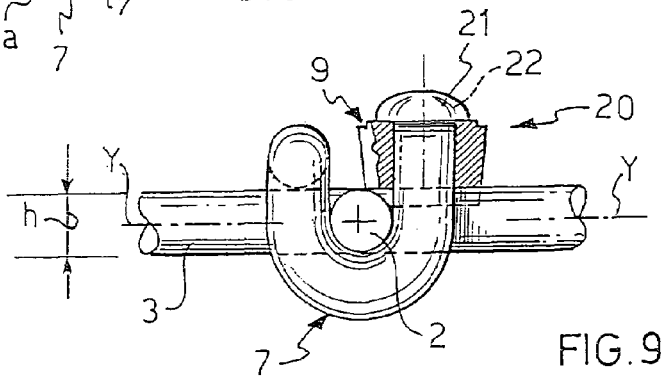
FIG. 9 is a partial section of the side view of the knot shown in FIG. 2, according to a modified embodiment of the invention.

This unique piece (see FIG. 8), generally shown with 11, is obtained by bending a steel cylindrical bar, which is a steel rod, whose diameter is dt, and it is preferably zinc-galvanized and it has distance, indicated with h, between tangent line t9 at the intrados of arch 9*d* and the plane defined by tangent lines t7, t8 at the intrados of curved bases 7*a*, 8*a*. The distance h varies between 1 and ⅔ the rope diameter d. In this example, h=d.

The yoke 9*e* is a steel parallelepiped bar, preferably zinc-galvanized. It has a semicylindrical depression 12 of radius R located midway of its length and faced to the rope 3 and two holes 13, 14 through which it is fit in a sliding way on the legs 7*e*, 8*e* of the two U elements 7, 8.

The clamping means 10 comprise two thread nuts 15 and 16, preferably zinc-galvanized, which are involved in the screwing with respective screw threads 17 and 18 provided at the ends 7*e* and 8*e*. The desired clamping is obtained by tightening up the nuts, thus provoking the pressing contact of the yoke 9*e* on the rope 3 and, as a reaction, the pressing contact of arch 9*d* on the same rope.

After the clamping, the ropes 2, 3, in correspondence of their crossing over area, press each other because of the displacement of the contacting strands, reducing their overall thickness of 1 to ⅔ the diameter d. In this way, the ropes 2 and 3 are forced to lie substantially in the same plane at each knot 4 of the net 1.

Preferably, during the clamping, a product against the unscrewing of the screw threads is applied. Alternatively, the threads could be locally deformed by means of burin and hammer.

According to a modified embodiment of the invention, junction 6 comprises clamping means 20 composed of two heads 21 and 22 respectively formed integrally in correspondence of the ends 7*e* and 8*e* of the wings 7*c*, 8*c* of the U elements 7 and 8. Because of the upsetting the heads 21 and 22 are forced to lean on yoke 9*b*. Being the heads 21 and 22 practically indestructible, also the clapping means 20 are irreversible, and the junction comes out to be inviolable.

A method of making retaining net knots, such as rock fences or avalanche fences, wherein a knot consists of a first and a second wire ropes crossing over each other and a binding junction of said ropes, comprises the steps of placing a first and a second U element astride said first rope and close to said second rope on opposite sides thereof, of linking the ends of the first U element to the ends of the second U element by means of at least one bridge element overlying said second rope, and of clamping said at least one bridge element on said second rope.

The main advantage of the invention is the high machanical strength reached by the net, both under static and impulsive stimulus: the junction according to the invention holds the ropes together like a ligament where they cross over and it forms a whole which is impossible to be divided into portions.

Another advantage is the excellent life expectancy of of the junction, being formed by massive elements.

In addition, the knot can be formed by means of relatively simple tools, such as presses, with screwers or riveters.

The net formed with knots according to the invention has also the advantage of being easily rolled up, also in coils with a small diameter, practically the one of the rope, which is important as far the transport and use while operating is concerned.

It should be noticed, moreover, that the junction binds the ropes firmly together without affecting their machanical strength. This is achieved because all the elements of the junction act on the ropes according to geodetic curves perpendicular to the axe of the ropes and to the direction of the rope twisting helix.

Obviously a skilled person in the art could make changes and modifications as for the disclosed method and junction, in order to satisfy specific, contingent needs, being all the modifications under the scope of the invention as defined in the following claims.

The invention claimed is:

1. A method for making retaining net knots, wherein a knot comprises a first and a second rope crossing over each other and a junction binding said ropes in a given crossover area, said ropes having the same rope diameter, the method comprising the steps of:

placing a first U-shaped element having a curved base and a second U-shaped element having a curved base positioned side-by-side astride said first rope, each U-shaped element with the same orientation at a distance from one another approximately equal to the rope diameter so that they lie close to said second rope on opposite sides thereof;

linking ends of the first U-shaped element to ends of the second U-shaped element by means of at least one bridge element overlying said second rope; and clamping with a clamping means said at least one bridge element on said second rope, wherein, during the clamping step by the action of the clamping means, the ropes press each other at their crossover area, because of the displacement of contacting rope strands, reducing the overall thickness of the first and second ropes pressed together to 1 to ⅔ of the rope diameter in such a way that the ropes are forced to lie substantially in the same plane at each knot of the net, and wherein the curvature of the curved base of each U-shaped element is semicircular, with an intrados radius of approximately one half the rope diameter, wherein said bridge element comprises a separable yoke linking an end of a wing of the first U-shaped element to an adjacent end of a wing of the second U-shaped element, and wherein said clamping means clamps said yoke on said second rope.

2. A knot of a retaining net comprising a first and a second rope crossing over each other and a junction for binding the ropes together, said ropes having the same rope diameter, wherein said junction comprises:

a first U-shaped element having a curved base and wings and a second U-shaped element having a curved base and wings positioned side-by-side astride said first rope, each U-shaped element with equally oriented wings at a distance from one another approximately equal to the rope diameter so that they lie close to the second rope on opposite sides thereof;

at least one bridge element linking ends of the wings of the first U-shaped element to adjacent ends of the wings of the second U-shaped element, and overlying the second rope; and clamping means for clamping said at least one bridge element on the second rope, wherein the bridge element comprises an arch which merges wit the adjacent ends of the first and second U-shaped elements and is integral with the first and second U-shaped elements to form a unique piece, and wherein said unique piece has a given distance measured between a tangent line at an intrados of an arch of the bridge element and the plane defined by tangent lines at the intrados of curved bases of the first U-shaped element and the second U-shaped element, wherein said given distance is between 1 and 4/3 of the rope diameter, and wherein the curvature of the curved base of each of the first and second U-shaped elements is semicircular, with an intrados radius of approximately one half of the rope diameter, wherein the clamping means comprises at least one of:

two nuts screwed on the ends of two wings of said U-shaped elements; and two heads formed through riveting, the heads corresponding to the ends of two wings of said U-shaped elements.

3. A junction for binding two ropes together in a knot of a retaining net, said ropes having the same rope diameter, the junction comprising:

a first U-shaped element having a curved base and wings and a second U-shaped element having a curved base and wings, positioned side-by-side and equally oriented, at a distance from one another approximately equal to the rope diameter;

at least one bridge element linking the ends of the first U-shaped element to the adjacent ends of the second U-shaped element, used to close the U-shaped elements, and clamping means of said at least one bridge element, wherein the at least one bridge element comprises an arch which merges with the adjacent ends of the first and second U-shaped elements and is integral with the first and second U-shaped elements to form a unique piece, wherein said unique piece has a given distance measured between a tangent line at an intrados of an arch of the bridge element and the plane defined by tangent lines at the intrados of curved bases of the first U-shaped element and the second U-shaped element, wherein said given distance is between 1 and 4/3 of the rope diameter, and wherein the curvature of the curved base of each of the first and second U-shaped elements is semicircular, with an intrados radius of approximately one half of the rope diameter, wherein the clamping means comprises at least one of:

two nuts screwed on the ends of two wings of said U-shaped elements; and two heads formed through riveting, the heads corresponding to the ends of two wings of said U-shaped elements.

* * * * *